US005487712A

United States Patent [19]

Kann

[11] Patent Number: 5,487,712

[45] Date of Patent: Jan. 30, 1996

[54] METHOD OF EXERCISING USING A PIVOTING EXERCISE APPARATUS

[76] Inventor: David M. Kann, 609 Cross Ridge Cir. North, Fort Worth, Tex. 76120

[21] Appl. No.: 193,278

[22] Filed: Feb. 8, 1994

[51] Int. Cl.[6] ..... A63B 21/06

[52] U.S. Cl. ..... 482/97; 482/93; 482/148

[58] Field of Search ..... 482/93, 97, 148, 482/54

[56] References Cited

U.S. PATENT DOCUMENTS 4,357,010 11/1982 Telle ..... 482/97

4,621,810 11/1986 Cummins ..... 482/97

*Primary Examiner*—Lynne A. Reichard

*Attorney, Agent, or Firm*—Geoffrey A. Mantooth

[57] ABSTRACT

A method of performing weight training exercises with a pivoting exercise apparatus is disclosed. A pivoting exercise apparatus is provided having a frame that is maintained in a vertical orientation by a base. An exercise bar is located across the frame. Weights may be located on the frame. To exercise, the frame is pivoted about the base from its vertical orientation to a non-vertical position by an exerciser. The frame is then moved from its initial non-vertical position to a different non-vertical position, requiring the exerciser to exert effort to move the frame. Repetitions of the movement may be done to increase the amount of effort exerted by the exerciser. The frame is then relocated back to its vertical orientation. Further exercises may be performed on the vertically oriented frame.

9 Claims, 2 Drawing Sheets

METHOD OF EXERCISING USING A PIVOTING EXERCISE APPARATUS

BACKGROUND OF THE INVENTION

1. Field of the Invention

The present invention relates to methods of performing exercises, and in particular, to methods of performing exercises with a pivoting exercise apparatus.

2. Description of the Prior Art

Physical exercise is beneficial to human health in many ways, improving circulation, immunity, physical strength, endurance, and mental alertness, among other health benefits. Weight training exercises provide physical exercise that builds up muscle mass while providing these health benefits.

Various exercise devices have been developed to assist in weight training exercises. Large scale weight machines provide an arrangement of weight lifting equipment arranged so that a variety of weight training exercises may be performed with the equipment. However, the large scale weight machines occupy a large area, are not easily moved, and are quite expensive. Therefore, large scale weight machines are not a practical alternative to the weight training exerciser who desires to have an apparatus for weight training exercise for home use.

Weight lifting benches with barbell weights and small weight machines, such as those having a single stack of weights, are capable of being located in a small area and may be used for weight training exercises in a home environment. However, only a limited range of exercises may be performed with the weight lifting benches and small weight machines because the benches and machines offer a limited range of equipment. Furthermore, a spotter is often required to keep the exerciser from being injured by the weights. Therefore, a small weight training apparatus and a method of using the apparatus is needed that will enable a weight training exerciser to perform a wide range of exercises without the aid of a spotter (within the suggested weight limits).

SUMMARY OF THE INVENTION

It is an object of the invention to provide a method of exercising with a pivoting exercise apparatus that enables an exerciser to perform a wide variety of exercises in a limited area without the aid of a spotter.

A vertically oriented frame having a bar extending across the frame is provided. An exerciser may perform exercises on the vertically oriented frame. The frame may be pivoted from its vertical orientation to a non-vertical position by the exerciser. The exerciser may be located outside of the pivoted frame or within an interior portion of the pivoted frame. The frame is then moved from its initial non-vertical position to a different non-vertical position with the bar, requiring the exerciser to exert effort to relocate the frame. Weights may be located on the frame to increase the amount of effort an exerciser must exert in order to relocate the frame. Repetitions of the movement may be done to increase the amount of effort exerted by the exerciser. The frame may then be relocated back to its vertical orientation.

The pivoting exercise frame and the method of using the frame to exercise provide many benefits. The frame is simple to use and to maintain since the frame has no mechanical moving parts that will break and require repair. Furthermore, an exerciser using the frame will receive the full benefit of the exercises performed since the exerciser's muscles do all the work and the exercise is not filtered through a mechanical apparatus. This is because the exerciser is lifting the frame (with or without weights) directly and not through the use of cables or cams. Exercises performed with the frame utilize the natural motions and positions of the exerciser's body to strengthen the muscles of the exerciser. For example, when pressing weight, the exerciser is standing, not lying on a bench. Few people lift heavy weight lying on their back on a bench. Furthermore, the exercise frame requires little storage space and may be located in its vertical position by a wall. People can even walk through the frame.

DESCRIPTION OF THE PREFERRED EMBODIMENT

Figure 1:
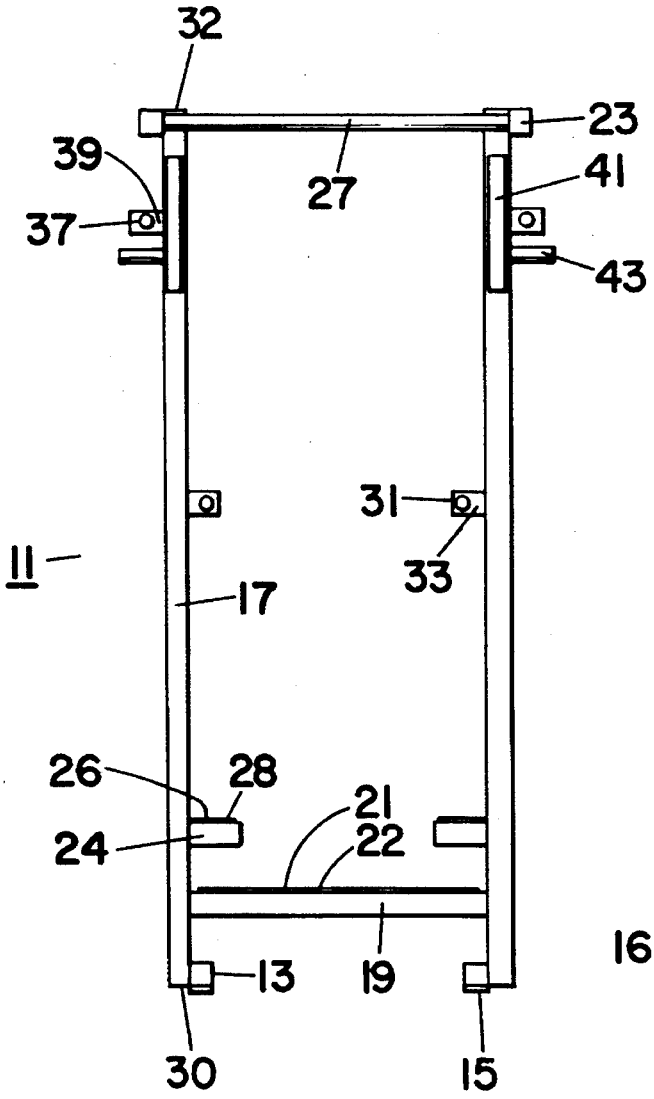
FIG. 1 is a front view of a pivoting exercise apparatus, upon which the method of the present invention can be practiced.
Figure 2:
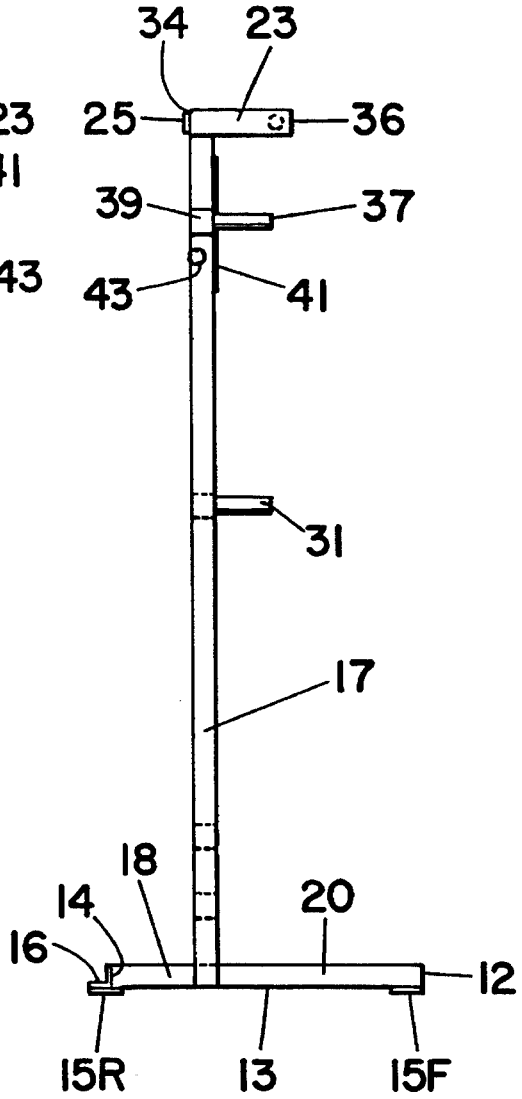
FIG. 2 is a side view of the pivoting exercise apparatus of FIG. 1.

Referring now to FIGS. 1 and 2, a frame 11 useful for performing physical exercises is shown. For certain exercises the frame 11 may be located in an upright position while for other exercises the frame 11 may be tipped to a lowered position. The tippable frame 11 allows a person to perform many varied physical exercises aided by the frame 11.

The frame 11 has two parallel base bars 13 upon which it rests when located in an upright position. The base bars 13 also support the frame 11 when the frame 11 is tipped. Each base bar 13 has front and rear rubber feet 15F, 15R located along the bottom of each end at the front and rear of the base bar 12, 14, respectively, so that the frame 11 will not slide along the surface upon which the frame 11 is located. The rubber feet 15F and 15R are positioned so that the feet 15F and 15R contact the surface upon which the frame 11 is located when the frame 11 is in its upright and tipped positions.

A metal toe 16 extends from the rear 14 of each base bar 13. The frame 11 may be tipped about the toes 16 in order to move the frame 11 from its upright position to a lowered position. The toes are welded to the base bars 13 to provide structural strength. Each rear rubber foot 15R extends from its base bar along the bottom of the toe 16 for the length of the toe 16, and is securely attached thereto. The rear rubber feet 15R contact the floor surface upon which the frame is located in both the upright and tipped positions.

Two parallel opposing side support bars 17 are coupled to the base bars 13 and extend transverse to the base bars 13 so that when the frame 11 is located in its upright position (as shown in FIGS. 1 and 2) the base bars 13 extend horizontally along the surface upon which the frame 11 is located while the side support bars 17 extend vertically upward from the base bars 13. Each side support bar 17 is welded to the outside of a respective base bar 13, where each side support bar 17 is located off-center along the length of its respective base bar 13. Long and short portions 18 and 20 of the base bars 13 are created by the off-centered side support bars 17, where the rear 14 of each base bar is located along the short portion 18 of each base bar. The off center positioning of the side support bars 17 enhances the ease of tipping the frame 11 about the toes 16 from its upright position as well as the ease of use of the tipped frame 11 for exercising, while providing stability when using the bar 27 with the frame in the vertical position. Preferably, the long portion 20 of each base bar 13 is about twice the length of the short portion 18 of its respective base bar 13.

A cross brace bar 19 extends transversely between the side support bars 17 to provide structural rigidity to the frame 11. The cross brace bar 19 is oriented transversely with respect to the base bars 13 and is located slightly above the base bars 13 when the frame 11 is in its upright position. Each end of the cross brace bar is welded to a side support bar 17. A rubber pad 21 is secured to the upward face 22 of the cross brace bar 19 to protect an exerciser from injury on the cross brace bar 19 and to provide traction to an exerciser standing on the cross brace bar to perform certain exercises.

Foot supports 24 are provided so that shorter exercisers may stand on the foot supports 24 while performing exercises when the frame 11 is located in an upright position. Each foot support 24 is welded to the inside of a side support bar 17 and extends inwardly from the side support bar 17. The foot supports 24 are located opposing each other on opposite side support bars 17 at a location slightly above and parallel to the cross brace bar 19 in the upright standing frame 11. A rubber or neoprene pad 26 is affixed to the upper face 28 of each foot support 24 to provide traction to an exerciser standing on the foot supports 24.

Two exercise bar supports 23 are welded to the side support bars 17. Each exercise bar support 23 is located along the outside of a respective side support bar 17. Each side support bar has first and second ends 30, 32, where each base bar 17 is located at the first end 30 of a side support bar 17 and each exercise bar support 23 is located at the second end 32 of a side support bar 17. When the frame 11 is located in an upright position the first end 30 of each side support bar 17 is located at the bottom of the frame 11 and the second end 32 of each side support bar 17 is located at the top of the frame. The exercise bar supports 23 extend transversely from the side support bars 17 parallel to each other and parallel with the base bars 13. The exercise bar supports 23 are oriented so that they extend from the side support bars 17 in the same direction that the long portions 20 of the base bars 13 extend from the side support bars 17. The exercise bar supports 23 are significantly shorter than the long portions 20 of the base bars 13. A rubber bumper 25 upon which the frame 11 may rest when the frame 11 is located in a lowered position is attached to the back end 34 of each exercise bar support 23.

An exercise bar 27 extends transversely between the exercise bar supports 23. The exercise bar 27 is positioned so that it may be gripped while performing a variety of exercises with the frame 11, including exercises performed with the frame 11 in its lowered position. The exercise bar 27 is welded between the respective front ends 36 of the exercise bar supports 23 so that the exercise bar 27 is rigidly attached to the frame 11. A cylindrical sleeve cushion (not shown) can be provided on the exercise bar 27. The cushion has a slit extending the length of the cushion so that the cushion may be removably located about the exercise bar 27 for the comfort of the user while certain exercises are performed.

Dip handles 31 and dip handle supports 33 are provided so that the dip handles 31 may be gripped in order to perform dip exercises while using the frame 11 in an upright position. Each dip handle support 33 is welded to the inside of a side support bar 17 and extends inwardly from the side support bar 17. The dip handle supports 33 are located opposing each other on opposite side support bars 17 about midway along the length of the side support bars 17. The dip handles 31 are welded to the dip handle supports 33 and extend outwards from the dip handle supports 33 and the side support bars 17 in the same direction the exercise bar supports 23 extend from the side support bars 17. Cylindrical dip handle sleeves (not shown) formed of neoprene are located over the dip handles 31 to provide a cushion about the dip handles 31.

Weight pegs 37 and weight peg supports 39 are provided on the frame 11 so that weights may be located on the weight pegs 37 for exercises requiring the use of weights. Two weight peg supports 39 are provided, each weight peg support 39 being located extending outwardly from a side support bar 17. Each weight peg support 39 is coupled to its respective side support bar 17 directly opposite the other weight peg support 39 so that weight added to the frame 11 by additional weights located on the weight pegs 37 may be distributed evenly on the frame 11. Furthermore, the weight peg supports 39 are located along the length of the side support bars 17 proximate to the exercise bar supports 23. The weight peg supports 39 are welded to the side support bars 17 for structural strength.

A weight peg 37 extends from each weight peg support 39, respectively. The weight pegs 37 are cylindrical rods capable of extending through the center of toroid-shaped weights. The weight pegs 37 are welded to the weight peg supports 39 and extend outwardly from the weight peg supports 39 oriented so that they extend in the same direction that the dip handles 31 extend from the dip handle supports 33. Multiple weights may be located on a weight peg 37 to increase the weight on the frame 11. The weights 38 are held in place on the weight peg 37 by a spring clamp 40 (see FIG. 3) which attaches to the weight peg 37 over the weights and prevents the weights from sliding off the peg 37. A rubber pad 41 is secured to the side support bars 17 adjacent each weight peg 37 and its respective weight peg support 39 to protect the frame 11 from being nicked by weights located on the weight peg 37.

Lift handles 43 are provided on the frame 11 so that lift exercises may be performed using the frame 11 in its lowered position. A cylindrical lift handle 43 extends outwardly from each side support bar 17 along the length of the side support bars 17 proximate to the weight handle supports 39 and opposite the other lift handle 43. The lift handles 43 are located so that the lift handles 43 may be easily reached by an exerciser when the frame 11 is located in its lowered position and the exerciser is located outside the frame 11 facing the exercise bar 27. The lift handles 43 are welded to the side support bars 17.

Bars 13, 17, 19, 23, 33, 39 are made of tubing that is square in cross-section and is welded together. The handles and pegs 27, 31, 37, 43 are cylindrical and are welded to the supports.

Figure 3:
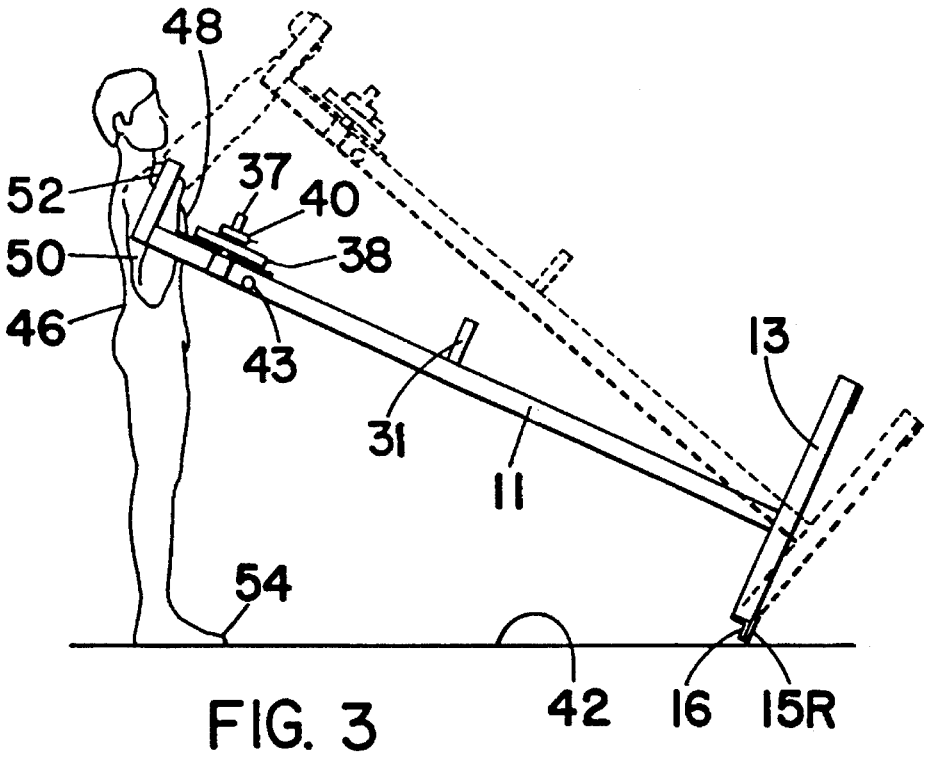
FIG. 3 is a view of an exerciser performing a standing press exercise from outside of the pivoting exercise apparatus.
Figure 4:
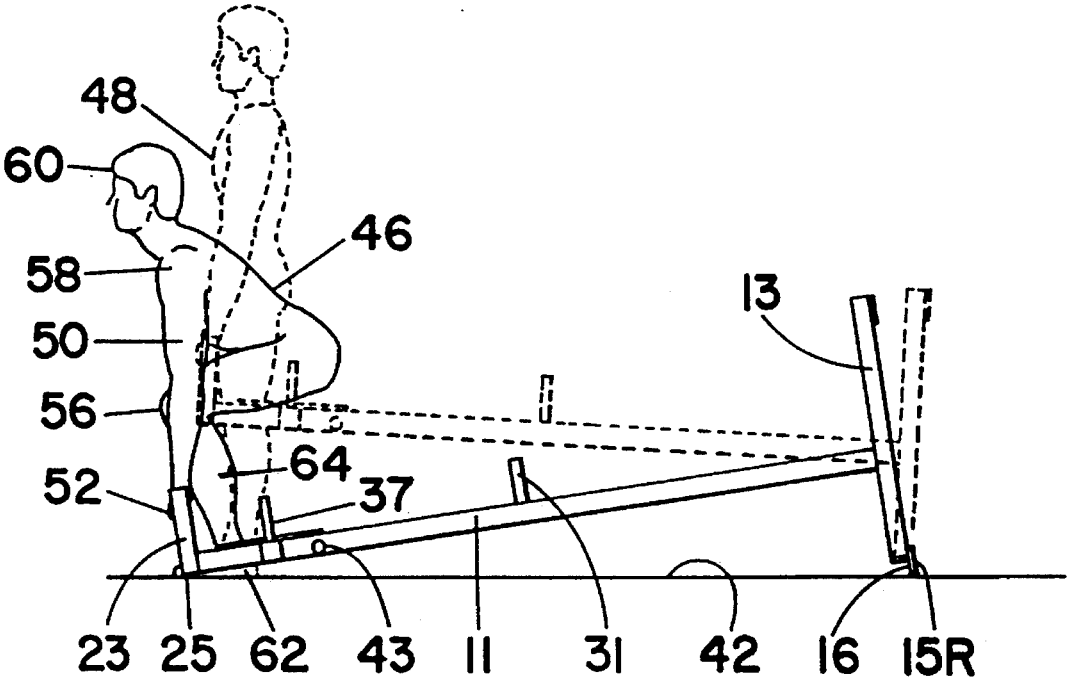
FIG. 4 is a view of an exerciser performing a dead lift exercise from inside the pivoting exercise apparatus.

As shown in FIGS. 2-4, in use the frame 11 may be located in either an upright position (FIG. 2) or a lowered position (FIGS. 3 and 4). As shown in FIG. 2, when located in an upright position, the base bars 13 extend parallel to the floor, the side support bars 17 extend vertically upwards, and the exercise bar 27 is located at the top of the frame 11. The dip handles 31 are located slightly over halfway up the vertically extending side support bars 17. The frame rests on the front and rear rubber feet 15F and 15R attached to the base bars 13 of the frame 11.

As illustrated in FIGS. 3 and 4, the frame 11 is tipped from its upright position about the toes 16 to locate the frame in a lowered position. The frame may assume many lowered positions depending on how far the frame is tipped from its vertical upright position. The lowest position the frame 11 may assume is shown in solid lines in FIG. 4, where the frame 11 rests on the floor on the rubber feet 15R attached to the toes 16 and the end caps 25 attached to the rear of the exercise bar supports 34.

Many exercises may be performed with the frame 11 in its upright and lowered positions. Referring now to FIG. 3, an exerciser 46 is shown outside of the frame 11 performing a standing press exercise with the frame 11. Weights 38 may be located on each of the weight pegs 37 and are secured on the weight pegs 37 with spring clamps 40 according to the amount of weight desired by the exerciser. The rear feet 15R are located on a non-slip surface 42. The exerciser 46 stands outside the frame 11 facing the exercise bar 27. The frame 11 is tipped from its vertical upright position (or raised from its roughly horizontal position) until the exercise bar 27 is located adjacent the exerciser's chest 48, as shown in solid lines in FIG. 3. The exerciser 46 may grasp the exercise bar 27 so that the exerciser is leaning forward into the bar and the exerciser's body is angled with respect to the floor. The exerciser 46 grasps the exercise bar 27 with his or her hands 52, and then uses his or her arms 50 to press the exercise bar 27 and the frame 11 with the weights 38 attached upwardly until the exerciser's arms 50 are fully outstretched, as shown by dashed lines in FIG. 3. After the exerciser's arms 50 are fully outstretched, the exerciser then brings the exercise bar 27 and the frame 11 back to the starting position with the exercise bar 27 adjacent to the exerciser's chest 48. The standing press may be repeated as many times as desired by the exerciser.

Frontal squat exercises may also be done from outside the frame 11 with the exerciser 46 facing the exercise bar 27. The cylindrical sleeve cushion (not shown) can optionally be located on the exercise bar 27 for comfort. Weights may be placed on the weight pegs 37 and secured with spring clamps. The frame 11 is located in a lowered position so that the exercise bar 27 is located against the exerciser's chest 48 as shown by the solid line frame 11 in FIG. 3, except that the exerciser's hands 52 are located gripping the lift handles 43. The exerciser leans forward into the frame 11 in order to firmly seat the exercise bar 27 against the exerciser's chest. The exerciser 46 then grasps the lift handles 43 along the side support bars 17 with both hands 52. The exerciser then moves from a standing position to a squatting position and back up again while holding the lift handles 43 and retaining the exercise bar 27 against the exerciser's chest. The frontal squat may be repeated as often as desired.

Toe raising exercises may also be done from outside the frame facing the exercise bar 27. Weights 38 are placed on the weight pegs 37 as desired and are secured thereon with spring clamps 40. Referring to FIG. 3, the frame 11 is located in a lowered position slightly lower than the frame shown in solid lines so that the exercise bar 27 may be comfortably grasped by the exerciser 46 when the exerciser's arms 50 are by the exerciser's sides. The exerciser grasps the exercise bar 27 and moves from a flat footed stance (as shown in FIG. 3) to a raised toe stance and back to a flat footed stance, lifting the exercise bar 27 by the action of raising to his or her toes 54. The toe raising exercise may be repeated as often as desired.

Several exercises may be performed from inside of the frame 11 when the frame 11 is located in a lowered position. As shown in FIG. 4, an exerciser 46 may perform a dead lift from inside the frame 11. The frame 11 is located in its lowest position with the rear feet 15R of the frame 11 located on a non-slip surface 42 as shown by the solid lines and the exerciser stands between the side support bars 17 facing the exercise bar 27. Weights are located on the weight pegs 37. As shown in solid lines, the exerciser 46 crouches down to grasp the exercise bar 27 with the exerciser's arms 50 extending straight down. The exerciser then raises the exercise bar 27 and the frame 11 by standing up and straightening his or her back while grasping the exercise bar 27 as shown by dashed lines in FIG. 4. The exerciser then returns to a crouched position.

Bent row exercises may be performed from the same starting position as the dead lift. As shown by the solid lines in FIG. 4, the frame 11 is located in its lowest position and the exerciser 46 is located in a crouched position within the frame 11. From the crouched position and looking forward the exerciser grasps the top of the exercise bar 27 with his or her hands 52 and pulls the exercise bar 27 up into his or her chest 48 while keeping his or her knees 56 bent. The exerciser 46 then slowly lowers the exercise bar 27 until the exerciser's arms 50 are straightened. Weights may be added to the weight pegs 37 on the frame 11 to increase the force required to lift the exercise bar 27 to the exerciser's chest.

Vertical row exercises may be performed with the frame 11 in much the same manner as the bent row exercise, except that the exerciser 46 stands inside of the frame 11 facing the exercise bar 27 instead of crouching, as shown by the dashed lines in FIG. 4. The frame 11 is located so that the top of the exercise bar 27 may be grasped by the exerciser 46 when the exerciser's hands 52 are by the exerciser's side.

Shoulder shrug exercises may also be performed from inside the frame 11. The exerciser 46 stands between the side support bars 17 facing the exercise bar 27. The frame 11 is located so that the exerciser 46 can grasp the exercise bar 27 with the exerciser's hands 52 when the exerciser's arms 50 are located by the exerciser's sides as shown by the dashed lines in FIG. 4. Weights may be placed on the weight pegs 37 if desired. The exerciser 46 grasps the exercise bar 27 and raises the frame 11 and weights by shrugging his or her shoulders 58. If desired, the exerciser may lean back toward the base 13 while performing the shrugs.

Curls are performed standing inside the frame 11 and grasping the underside of the exercise bar 27 at waist level with the frame 11 located slightly higher than shown by the dashed lines in FIG. 4. Weights may be located on the weight pegs 37. The exerciser raises and lowers the exercise bar 27 and the frame 11 repeatedly using only his or her arms 50. If desired, the exerciser can lean back into the frame 11 towards the base 13 while performing the curls.

Squat exercises may also be performed inside of the horizontal frame. The exerciser stands near the bar 27, facing the base 13. The exerciser grasps the bar 27 with the arms behind the back. The arms are extended. The exerciser then squats up and down.

All exercises that pivot or move the frame 11 can be done with or without weights on the pegs 37.

Other exercises may be performed from a prone position within the frame 11 located in its lowest position as shown by solid lines in FIG. 4. Triceps extension exercises may be performed within the lowered frame 11. An exerciser 46 lays down inside the frame 11 so that the exerciser's forehead is located close to the exercise bar 27 and the exerciser's feet are located towards the base bars 13 of the frame 11. The exerciser grasps the exercise bar 27 so that his or her arms are parallel and the elbows are up in the air. The exerciser then pushes up on the exercise bar 27 until his or her arms 50 are straightened. The exercise bar 27 is then slowly lowered to its initial position. If desired, weights may be placed on the weight pegs 37 for the triceps extension exercises.

Elevated push-ups may be performed using the frame 11 in its lowered position shown by solid lines in FIG. 4. The exerciser 46 may perform push-ups in which the exerciser's arms are located above the exerciser's legs, by locating the exerciser's hands on the cross brace bar 19 or foot supports 24 of the frame 11. The cross brace bar 19 of the frame 11 is raised with respect to the floor. The exerciser's non-elevated feet are located on the floor between the side support bars 17. The exerciser may then perform elevated push-ups. Elevated push-ups may also be performed with the exerciser's feet located on the cross brace bar 19 and the exerciser's hands located on the floor.

The exerciser may also perform triceps presses by using the elevated foot supports 24 of the frame 11 in its lowered position shown by solid lines in FIG. 4. The exerciser 46 stands inside the frame 11 facing away from the foot supports 24. The exerciser then squats down and grasps the foot supports 24 located behind the exerciser with his or her hands 52. The exerciser 46 then presses up and down against the foot supports 24 with his or her arms 50.

Several more exercises may be performed with the frame 11 located in its vertical upright position as shown in FIGS. 1 and 2. An exerciser may do chin-ups by grasping the exercise bar 27 with upwardly extending arms, then pulling himself or herself up to the exercise bar until the exerciser's chin is located proximate to the bar, and then returning to the exerciser's initial position. The exerciser may stand on the cross brace bar 19 or the foot supports 24 while performing the chin-ups. An exerciser may perform leg lifts by grasping the exercise bar 27 with upwardly extending arms, bending his or her knees to assume a hanging sitting position, pulling the knees inwards towards the chest, and then returning to the hanging sitting position. The exerciser may perform dips by grasping the dip handles while located within the frame 11, pushing upwards until his or her arms lock in a straightened position, and then lowering himself or herself by slowing bending his or her arms from the locked position. Finally, the exerciser may perform crunches using the upright frame by locating his or her feet between the cross brace bar 19 and the floor, assuming a prone position on the floor, face up for a front crunch, face down for a back crunch, and performing a sit-up for a front crunch or a back arch for a back crunch while the exerciser's feet are being held between the cross brace bar 19 and the floor.

The exercises described above, as well as the description of the frame and its use, are intended to be illustrative, and not limiting and should be interpreted as merely illustrative. The scope of the invention is to be determined from the claims.

I claim:

1. A method of exercising with an exercise apparatus, comprising the steps of:

providing a vertically oriented frame having first and second ends, where a bar extends across said second end of the frame and said first end is coupled to a base that is located on a floor surface, said base being horizontally oriented;

locating weights directly on said vertically oriented frame;

pivoting said vertically oriented frame and said base so that said frame moves from a vertical orientation to a first non-vertical position and said base moves from a horizontal orientation to a non-horizontal orientation;

moving said frame together with said base by way of said bar so that said frame moves from said first non-vertical position to a second non-vertical position.

2. The method of exercising with an exercise apparatus of claim 1, wherein the step of moving said frame by way of said bar from said first non-vertical position to a second non-vertical position further comprises the step of lifting said frame with said bar from a lower first non-vertical position to a higher second non-vertical position.

3. The method of exercising with an exercise apparatus of claim 3, wherein said exercise apparatus is for use by a human, said lower first non-vertical position is a chest high position relative to the human and said second non-vertical position is an overhead position relative to the human.

4. The method of exercising with an exercise apparatus of claim 1, wherein the step of moving said frame with said bar from said first non-vertical position to a second non-vertical position further comprises the step of lowering said frame with said bar from a higher first non-vertical position to a lower second non-vertical position.

5. The method of exercising with an exercise apparatus of claim 1, wherein said step of lowering said frame with said bar further comprises the step of lowering said frame with said bar by squatting.

6. The method of exercising with an exercise apparatus of claim 1, further comprising the of:

the step of providing a frame further comprises the step of providing a frame having an interior portion;

after providing a vertically oriented frame, locating weights directly on said vertically oriented frame;

the step of moving said frame further comprises the step of moving said frame by way of said bar from within said interior portion of said frame from said first non-vertical position to said second non-vertical position;

the step of moving said frame by way of said bar from said first non-vertical position to said second non-vertical position further comprises the step of lifting said frame with said bar from a lower first non-vertical position to a hiker second non-vertical position.

7. The method of exercising with an exercise apparatus of claim 1, further comprising the step of:

the step of providing a frame further comprises the step of providing a frame having an interior portion;

after providing a vertically oriented frame, locating weights directly on said vertically oriented frame;

the step of moving said frame further comprises the step of moving said frame by way of said bar from within said interior portion of said frame from said first non-vertical position to said second non-vertical position;

the step of moving said frame with said bar from said first non-vertical position to said second non-vertical position further comprises the step of lowering said frame with said bar from a higher first non-vertical position to a lower second non-vertical position.

8. A method of exercising with an exercise apparatus, comprising the steps of:

providing a vertically oriented frame having a base designed to maintain said frame in a vertical orientation, and having a bar extending thereacross;

locating weights directly on said vertically oriented frame;

pivoting said frame and said base so as to locate said frame in a first non-vertical position;

pivoting said frame and said base by way of said bar from said first non-vertical position to a second non-vertical position.

9. A method of exercising with an exercise apparatus, comprising the steps of:

providing a vertically oriented frame having first and second ends, where a bar extends across said second end of the frame and said first end is coupled to a base that is located on a floor surface, said base being horizontally oriented;

providing pins that extend from said frame;

pivoting said vertically oriented frame so as to lie on a floor surface and so that said pins are vertically oriented;

locating weights directly on said frame by way of said pins;

moving said frame together with said base by way of said bar so that said frame moves from a said first non-vertical position to a second non-vertical position.

* * * * *